United States Patent [19]

Mraz

[11] Patent Number: 4,818,144

[45] Date of Patent: Apr. 4, 1989

[54] FLOOD ISOLATION DAM

[76] Inventor: Dennis Mraz, 410 Jessop Ave., Saskatoon, Saskatchewan, Canada, S7N 2S5

[21] Appl. No.: 930,424

[22] Filed: Nov. 14, 1986

[51] Int. Cl.[4] ..... E21D 9/00

[52] U.S. Cl. ..... 405/132; 299/12; 405/150; 405/263

[58] Field of Search ..... 405/132, 144, 150, 263, 405/267; 299/10, 12, 19

[56] References Cited

U.S. PATENT DOCUMENTS

| | | | |
|---|---|---|---|
| 2,976,691 | 3/1961 | Edholm . | |
| 3,068,654 | 12/1962 | Warren | 405/132 X |
| 3,422,627 | 1/1969 | Courte . | |
| 3,817,039 | 6/1974 | Stewart et al. . | |
| 3,925,992 | 12/1975 | Bäckström . | |
| 4,008,576 | 2/1977 | Meyer et al. | 299/12 X |
| 4,036,024 | 7/1977 | Dreker et al. | 405/144 X |
| 4,294,563 | 10/1981 | Kilburn | 405/132 |
| 4,315,657 | 2/1982 | Burton | 405/132 X |

FOREIGN PATENT DOCUMENTS

| | | |
|---|---|---|
| 916458 | 12/1972 | Canada . |
| 928090 | 6/1973 | Canada . |
| 929362 | 7/1973 | Canada . |
| 944168 | 3/1974 | Canada . |
| 1112466 | 11/1981 | Canada . |
| 1126040 | 6/1982 | Canada . |

*Primary Examiner*—David H. Corbin

*Attorney, Agent, or Firm*—Welsh & Katz

[57] ABSTRACT

In situations where pressurized unsaturated brine or other unwanted liquid seeps through incompetent or soluble rocks, a pair of dams are constructed within a passageway, and the interface between the dams and the host rock is sealed. Thereafter, a hydrophobic liquid is injected under pressure within the passageway between the two dams thus impregnating the microfracture system within the host rock. A monitoring installation is used to sample the area on the flood side of the first barrier. This flood isolation method is also useful in containing other wastes such as in nuclear repositories.

10 Claims, 1 Drawing Sheet

FLOOD ISOLATION DAM

BACKGROUND OF THE INVENTION

This invention relates generally to the control of unwanted seepage in below-ground environments, and more particularly is directed towards isolating unsaturated brines from mining passageways.

Underground liquid seepage in mines and other below ground level situations has been a continual problem since the time mines and other underground storage facilities were first created. Numerous attempts have been made to seal off passageways and prevent the seepage of unwanted liquids. This problem is most acute where the host rock is an incompetent or soluble rock such as that found in salt rocks or near potash deposits.

One method used to prevent this seepage was to pour in, through a suitable entry method, aggregates of fly ash and cement to seal the passageway. Nevertheless, a certain amount of high pressure unsaturated brines and other unwanted liquid mobile substances travelled through the microfractures of the surrounding host rock and seepage continued.

More recently, in the art of isolating unwanted liquids underground, U.S. Pat. No. 3,925,992 issued to Backstrom for a method and reservoir for storing nuclear residues in an underground rock cavity reservoir comprised of surrounding a container for the resudues with a viscous liquid such as bitumen or Bentonite having a density somewhat above that of water which has sealing action on cracks in the container and/or the surrounding rock formation. The container is connected to the walls of the rock formation. The container is connected to the walls of the rock cavity by means of resilient or flexible supports. The aforementioned patent is somewhat successful in dealing with underground seepage of pressurized liquids but has not eliminated the problem.

The problem is particularly acute in deep potash mines located in Canada, where flooding has occurred in salt rocks consisting of more than one mineral such as sylvite, carnallite, and halite. Even at very low pressures, unsaturated brine will bypass an engineered barrier through the cracks and fractures in the wall of the mine opening adjcent to it. In addition to bedding planes and other lithological discontinuities there are fractured zones in the area subjected to stress concentrations during and after the excavation of an opening.

Prior to constructing a barrier, all fractured and otherwise potentially discontinuous material must be removed. However, even a complete removal of all such material will not prevent infiltration of brine into the stress relieved zones around the opening. Scanning electronic microscope photographs of potash specimens have shown that stress relieved potash rock is full of microcracks resulting from the difference in strains of the sylvite and halite crystals. Therefore, it has now become known that a successful design of the isolation structure should not only contain an impermeable seal at the interface of the rock and the dam or barrier, but should also prevent migration of the brine through microfracture systems in the vicinity of the structure.

SUMMARY OF THE INVENTION

A primary object of the present invention is to provide a method and a construction for an isolation structure that contains an impermeable sealto interface with the rock and dam and prevent migration of brine through the microfracture system in the vicinity of the structure.

By impregnating the microfracture system in the vicinity of the structure with high pressured hydrophobic liquid, a great deal of the migration of the brine is stopped. This is accomplished by constructing two barriers between which diesel fuel or some other hydrophobic liquid is injected under pressure. A sump is located in the area between the two barriers to collect any brine which has seeped around or through the first barrier. The brine is of greater specific gravity than the hydrophobic liquid, and therefore settles in the sump from where it can be withdrawn.

The present invention provides for a method of isolating flooding liquid in incompetent or soluble rocks comprising the steps of: (a) constructing a first impervious barrier within a passageway; (b) constructing a second impervious barrier within the passageway spaced from the first impervious barrier; and (c) injecting a liquid into the area of the passageway located between the barriers in a manner to resist the entry of unwanted liquid into the area from the surrounding rock.

In another aspect of the invention there is provided a method for high pressure flood dam isolation of unsaturated brines in salt rock comprising the steps of: removing all fractured or otherwise potentially discontinuous material in the wall of a mine opening; constructing first and second dams across the mine opening; sealing the host rock on the pressure side of the first or upstream dam; injecting the hydrophobic medium under pressure between the first and second dams; sealing the microfracture system in the host rock around the first and second dams through rock repressurization; impregnating the microfracture system within the host rock with a hydrophobic medium; mionitoring the fluid on the pressure side of the first barrier; and withdrawing any seepage of fluid from a sump located between the first and second dams.

The invention also comprises an underground construction for preventing flooding by unwanted substances in an incompetent or soluble rock environment comprising: first and second impermeable barriers separating the unwanted substance from the surrounding environment; and a pressurized injected hydrophobic liquid disposed between the first and second barriers.

BRIEF DESCRIPTION OF THE DRAWINGS

The invention is more clearly described in conjunction with the following drawing wherein.

DETAILED DESCRIPTION

Figure 1:
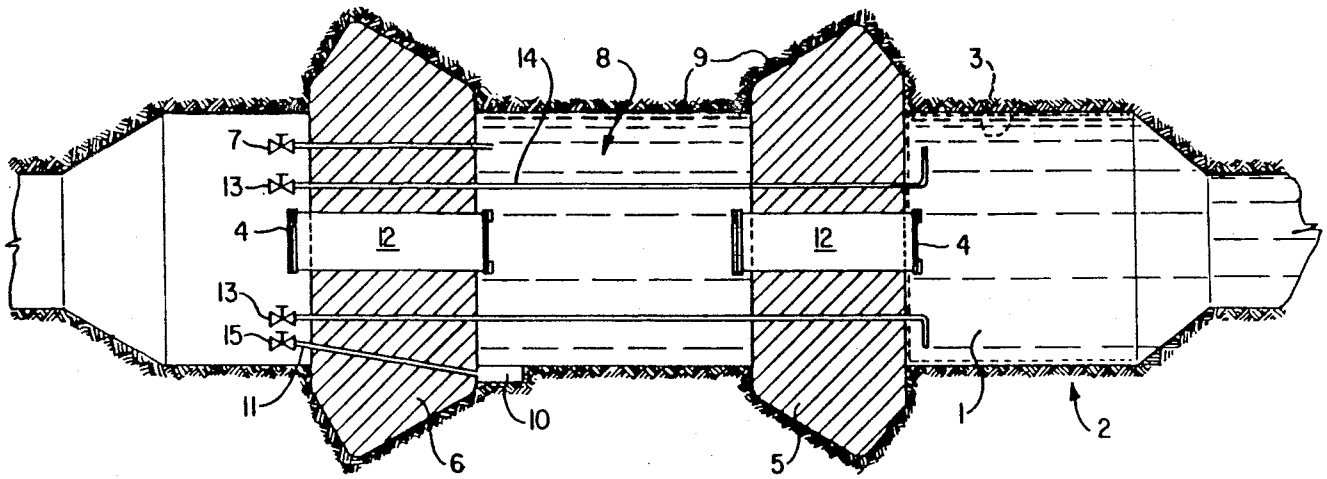
FIG. 1 is a generally vertical longitudinal cross-section of the construction of the invention located in a below-ground horizontal mining passageway.

In FIG. 1 a passageway 1 located in a deep mine of surrounding salt rock 2 or other incompetent or soluble rock is filled with unsaturated brine or high pressure water. The fragmented or broken salt rock 9 is removed around the area where a first dam 5 is to be installed. The dam 5 is made of an impervious material such as poured concrete. The high pressure side of the dam 5 in contact with the passageway full of brine and adjacent surface of the passageway is coated with an elastomer liner 3. The function of the liner is to prevent penetration of brine to the rock adjacent the dam 5. A second dam 6 is constructed in a similar manner to the first dam 5 and spaced downstream therefrom. The area between the two dams is equipped with a sump 10 which is connected to a sump withdrawal passageway 11 having a valve 15. After the two dams have been constructed and are in place, pressurized diesel fuel or similar hydrophobic material 8 is injected by means of an injector 7 into the area between the two dams. Microcracks in the host rock 9 surroundign the open area between dams 5 and 6 are partly closed by pressure as well as filled with the hydrophobic liquid, thereby resisting the entry of high pressure brine through the cracks. Sampling valves 13 are connected through lines 14 to the high pressure water or unsaturated brine area 1. Access passages 12 are located within the dams 5 and 6 for maintenance or inspection purposes and pass horizontally therethrough. These access channels 12 are equipped with ports 4.

Once the construction thus far described is in place, the high pressure water or brine in area 1 can be monitored through the sampling mechanism 13 from time to time. If any brine enters into the area where the pressurized diesel fuel 8 is located, its higher specific gravity will cause it to fall to the bottom of the area into the sump 10. The sump valve 15 is turned on and the brine withdrawn until diesel fuel appears. Thereafter, diesel fuel can again be injected through area 7 to maintain the correct pressure.

The construction and method of the present invention is not limited to the specific embodiment herein described, but encompasses all embodiments where pressurized hydrophobic material is placed between two barriers to ensure flood isolation in incompetent or soluble rocks.

Moreover, this type of double barrier with pressurized fuel therebetween can be used to encompass rock cavities or underground storage areas where nuclear wastes or other undesirable fluids are located, thus preventing any seepage into the surrounding environmental rock.

What I claim as my invention is:

1. A method for high pressure flood dam isolation of unsaturated brines in salt rock comprising the steps of:

(a) removing all fracture or otherwise potentially discontinuous material in the wall of a mine opening;

(b) constructing first and second dams across said mine opening, said first dam defining a pressure side, and said wall having a microfracture system peripherally of said dams;

(c) sealing the host rock on the pressure side of said first dam;

(d) injecting hydrophobic medium under pressure between said first and second dams;

(e) sealing the microfracture system in the host rock around said first and second dams through rock repressurization;

(f) impregnating the microfracture system within the host rock with hydrophobic medium;

(g) monitoring the pressure on the pressure side of said first barrier; and (h) withdrawing any seepage from a sump located between said first and second dams.

2. A method according to claim 1 wherein said injected hydrophobic medium comprises diesel fuel under pressure.

3. A method according to claim 1 wherein said step of sealing said host rock comprises coating said host rock with a sealing liner.

4. An underground construction for preventing flooding by unwanted substances into a passage formed in incompetent or soluble rock comprising:

(a) first and secod impermeable barriers disposed in said passage in spaced relation to each other and having peripheral surfaces engaging the rock in generally sealed relation circumferentially of said barriers;

(b) a hydrophobic liquid in the passage area between said first and second barriers, said hydrophobic liquid being of sufficient volume and pressure to effect entry into any microfractures in the rock surrounding said passage area and substantially prevent unwanted substances from entering into said passage area from the surrounding rock and flowing past said barriers;

(c) a sump between said barriers for the collection of unwanted liquid;

(d) sump withdrawal means enabling withdrawal of liquid from said sump; and (e) monitoring means enabling the pressure on the pressure side of said first barrier to be monitored.

5. A construction as defined in claim 4 including fluid injection means operatively associated with said second barrier so as to enable injection of hydrophobic liquid into the area between said first and second barriers.

6. A construction as defined in claim 4 wherein said second barrier has an outside facing away from said area between said barriers, and including sampling means comprising a communication channel and shut-off valve between the outside of said second barrier and said unwanted substance.

7. A construction as defined in claim 4 wherein said second barrier defines a first access channel and port between an outside of second barrier and the area between said barriers, and said first barrier defines a second access channel and port between said unwanted substances and said area between said first and second barriers.

8. A construction as defined in claim 4 including a sealed lining around the area encompassing said unwanted substances.

9. A construction as defined in claim 8 wherein said lining is sprayed on as an elastomer liner.

10. A construction as claimed in claim 4 wherein said hydrophobic liquid is diesel fuel.

* * * * *

UNITED STATES PATENT AND TRADEMARK OFFICE

CERTIFICATE OF CORRECTION

PATENT NO. : 4,818,144

DATED : April 4, 1989

INVENTOR(S) : Dennis Mraz

It is certified that error appears in the above-identified patent and that said Letters Patent is hereby corrected as shown below:

Column 1, line 18, "method" should be deleted.

Column 1, lines 25-26, "Backstrom" should be --Bäckström--.

Column 1, line 28, "resudues" should be --residues--.

Column 1, lines 32-33, "The container is connected to the walls of the rock formation." should be deleted.

Column 1, line 45, "adjcent" should be --adjacent--.

Column 1, line 67, "sealto" should be --seal to--.

Column 3, line 8, "surroundign" should be --surrounding--.

Column 4, line 14, "secod" should be --second--.

Column 4, line 48, "substances" should be --substance--.

Signed and Sealed this

Ninth Day of January, 1990

*Attest:*

JEFFREY M. SAMUELS

*Attesting Officer*

*Acting Commissioner of Patents and Trademarks*